United States Patent [19]

Foster

[11] Patent Number: 5,000,019

[45] Date of Patent: Mar. 19, 1991

[54] CYLINDER LOCK AND METHOD FOR USING SAME

[76] Inventor: Merle L. Foster, R.R. 5, Boone, Iowa 50036

[21] Appl. No.: 390,296

[22] Filed: Aug. 7, 1989

[51] Int. Cl.[5] ..... E05B 11/00; E05B 35/10

[52] U.S. Cl. ..... 70/338; 70/341; 70/375; 70/383; 70/389; 70/493

[58] Field of Search ..... 70/382–384, 70/493, 721, 338, 340, 341, 375, 389, 419

[56] References Cited

U.S. PATENT DOCUMENTS

| | | | |
|---|---|---|---|
| 1,232,035 | 7/1917 | Hurd | 70/341 |
| 1,796,098 | 3/1931 | Hardy | 70/383 |
| 1,896,319 | 2/1933 | Littell et al. | 70/382 |
| 2,113,007 | 4/1938 | Swanson | 70/382 |
| 2,427,837 | 9/1947 | Connell | 70/383 |
| 2,922,298 | 1/1960 | Wiener | 70/375 |
| 3,467,983 | 8/1969 | Evanish | 70/383 |
| 3,605,462 | 9/1971 | Hermann | 70/375 X |
| 4,116,026 | 9/1978 | Flint | 70/383 |
| 4,185,480 | 1/1980 | Pechner | 70/383 X |
| 4,631,941 | 12/1986 | Sjunnesson | 70/337 |
| 4,732,023 | 3/1988 | Shen | 70/383 |

FOREIGN PATENT DOCUMENTS

| | | | |
|---|---|---|---|
| 145780 | 5/1936 | Austria | 70/383 |
| 2066347 | 7/1981 | United Kingdom | 70/383 |

*Primary Examiner*—Lloyd A. Gall

*Attorney, Agent, or Firm*—Zarley, McKee, Thomte, Voorhees, & Sease

[57] ABSTRACT

The cylinder lock of the present disclosure includes a cylinder housing having either two or three rows of cylinder holes therein. The cylinder holes are in communication with an elongated cylindrical bore in which is inserted a cylindrical plug having a single row of plug holes. The plug can be rotated to each of the two or three rows of cylinder holes in order to permit the exchange of various pins within the cylinder holes and thereby permit the recording of the lock. One modification of the invention utilizes a notch adjacent one of the plug holes for permitting the key to rotate in one direction, but for preventing the key from rotating in another direction. A further modification utilizes an enlarged pin in one of the rows of cylinder holes so as to permit an access key to unlock the lock once, but preventing the access key from unlocking the lock a second time.

8 Claims, 13 Drawing Sheets

CYLINDER LOCK AND METHOD FOR USING SAME

BACKGROUND OF THE INVENTION

The present invention relates to a cylinder lock and a method for using same.

Cylinder locks conventionally include a housing having a cylindrical bore extending longitudinally therein. Within the bore is a plug which is mounted for rotation within the bore. The plug has a keyway for receiving a key and a row of plug holes therein having pins slidably movable within each of the holes. The housing also has a row of cylinder holes which are adapted to align with the plug holes within the plug. The cylinder holes include spring-mounted pins therein also.

When a key having the appropriate shape is inserted into the keyway, it aligns the pins in such a manner that the junctures between the pins correspond with the outer cylindrical surface of the plug. This permits the plug to rotate.

In many applications, it is necessary to be able to change the combinations of pins within the lock so that different shaped keys will work. Such an example may be found in apartment buildings where the owner desires to change the lock after a tenant has moved out of a particular apartment.

The present methods for changing these locks involve removing the lock entirely and inserting new sets of pins within the cylinder holes and plug holes s that the original key which opened the lock will no longer work, and so then a new key is required to open the lock.

Another problem encountered in many situations is the need for a service key which can be used to lock a particular door, but which will not open the lock once it is in its locked position. This particular type of lock has application where an employer desires to give an employee the ability to lock a door, but not the ability to open it.

Another feature which is desirable in many instances is the ability to give a person a key which will unlock the door once, but which will not unlock the door once it is locked a second time.

Therefore, a primary object of the present invention is the provision of an improved cylinder lock and method for using same.

A further object of the present invention is the provision of an improved cylinder lock which can have its pin combination changed without the need for removing the lock and manually repinning all of the channels or holes therein.

A further object of the present invention is the provision of a lock which can be set in a predetermined condition so that an access key will permit the door to be locked, but will not unlock the door.

A further object of the present invention is the provision of a cylinder lock which will accommodate an access key capable of opening the lock a single time, but which is incapable of unlocking the lock after it has been locked a second time.

A further object of the present invention is the provision of a device which is economical to manufacture, durable in use, and efficient in operation.

SUMMARY OF THE INVENTION

The present invention utilizes a cylinder housing having two or three rows of cylinder holes. The rotatable plug has a single row of plug holes which can be moved into alignment with each of the rows of cylinder holes.

Various code keys can be inserted into the plug which will cause different combinations of pins to be retained within the plug holes. The code keys can then be used to rotate the plugs so as to carry the pins within the plug to alignment with a different row of cylinder holes. This causes a change in the combinations of pins in the various cylinder rows, and thus permits the recoding of the combinations of pins in the various rows.

One modification of the present invention utilizes a circumferentially extending tapered slot adjacent one of the plug holes. This tapered slot permits an access key to rotate the plug in one direction, but prevents the access key from rotating the plug in an opposite direction. Thus, it makes possible the use of an access key which will permit the closing or locking of a lock, but which will not permit the plug to be rotated in the opposite direction to open the lock.

Another modification of the present invention utilizes two rows of cylinder holes. One of the cylinder holes in one of the rows is larger in diameter than all the remaining cylinder holes, and the pin within that cylinder hole is larger in diameter than the plug holes within the plug. The plug hole which aligns with the enlarged cylinder hole also includes a tapered slot adjacent its outer end. With this structural arrangement, it is possible to provide a unique pin combination which will accommodate an access key capable of opening the lock one time only. After the access key has been used to open the lock once, it will no longer open the lock after it has been relocked a second time.

A further modification of the present invention utilizes three rows of cylinder holes. In the first row, a plurality of pins of a first size are provided, and in the third row, a plurality of pins of a second size are provided. It is then possible to shift with various code keys the pins from the first and third rows into the second row to create unique combinations of pins. Thus, it is possible to change the combination of pins in the third row so that the third row will accommodate keys of unique shapes for opening and closing the lock.

DETAILED DESCRIPTION OF THE PREFERRED EMBODIMENT

Figure 1:
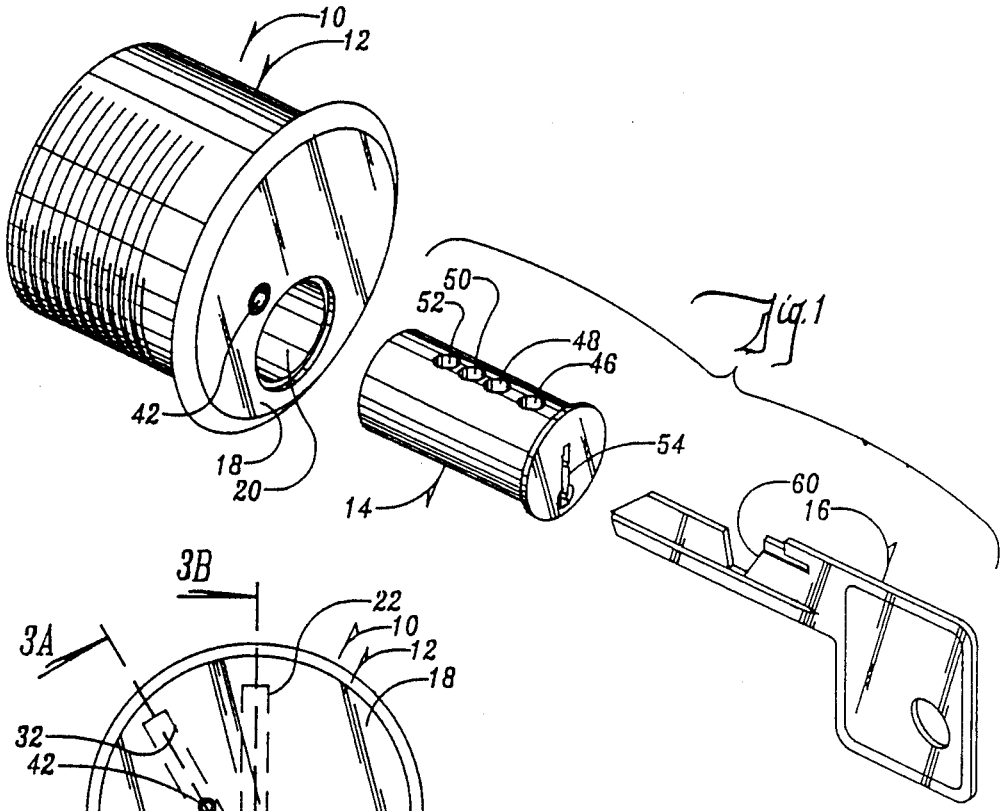
FIG. 1 is an exploded perspective view of one form of the present invention.

Referring to FIGS. 1–9C, a cylindrical lock 10 is shown. Lock 10 comprises a cylinder body or housing 12, a cylindrical plug 14, and a master key 16. Housing 12 includes a front face 18, and includes an elongated cylindrical bore 20 extending therethrough. Extending radially outwardly from cylindrical bore 20 is a main row or first row of cylinder holes designated by the numeral 22, and containing the cylinder holes 24, 26, 28, 30. The number of cylinder holes may be larger or smaller than four, and the particular number of holes utilized does not affect the present invention. A second row 32 of cylinder holes 34, 36, 38, 40 is also in communication with bore 20 and is circumferentially displaced from first row 22. A set screw 42 extends axially into the front face 18 of housing 12 and is adapted to protrude within cylinder hole 34 as is illustrated in FIG. 3A.

Cylinder plug 14 includes a row of plug holes, 46, 48, 50, 52 which are sized and spaced so as to be capable of registering with the first row 22 of cylinder holes or the second row 32 of cylinder holes. Plug 14 is rotatably inserted within bore 20 and is capable of rotating from a first position, wherein plug holes 46, 48, 50, 52 are registered with the cylinder holes of row 22 to a second position wherein the plug holes are registered with the cylinder holes in the second row 32. An elongated keyway 54 is provided in plug 14 and includes an elongated ledge 56 formed therein.

Figure 3A:
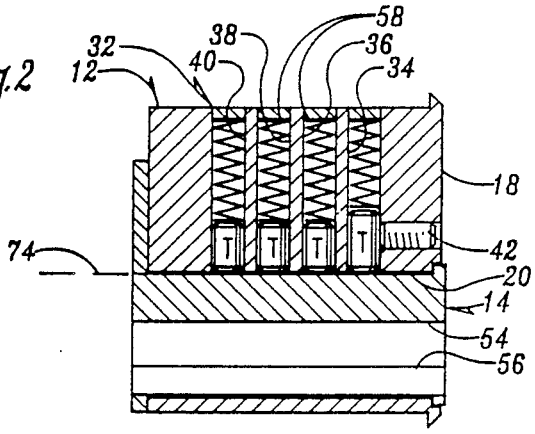
FIG. 3A is a sectional view taken along line 3A–3A of FIG. 2.
Figure 3B:
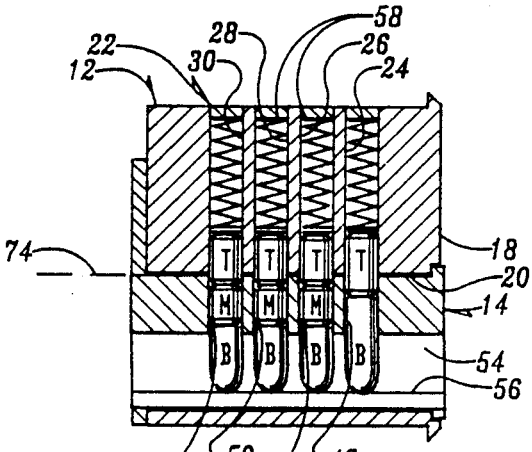
FIG. 3B is a sectional view taken along line 3B–3B of FIG. 2.

FIGS. 3A and 3B show the pin arrangements within rows 22, 32 of cylinder holes and within the row of plug holes 46, 48, 50, 52. FIGS. 3A and 3B show the plug 14 without a key in it, and in the vertical position with keyway 54 aligned with row 22 of cylinder holes. FIG. 3B shows a spring 58 inserted within the top of each cylinder hole 24, 26, 28, 30. Immediately below spring 58 is a top pin designated by the letter T. Plug holes 46, 48, 50, 52 each contain a bottom pin designated by the letter B which rests upon ledge 56. Between the top pin T and the bottom pin B of each hole 26, 28, 30 is a middle pin designated by the letter M. Plug hole 24 does not include a middle pin. The top pins T in FIG. 3B show their lower ends extending slightly into the upper ends of plug holes 46, 48, 50, 52. This prevents rotation of plug 14 when there is no properly coded key within keyway 54.

Figure 2:
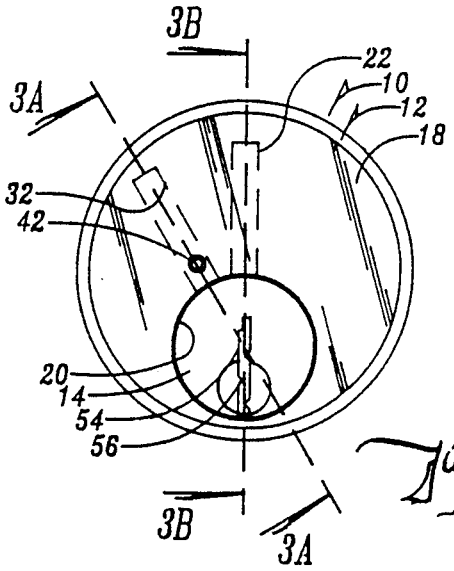
FIG. 2 is a front elevational view of the device of FIG. 1.

FIG. 3A shows the pin arrangement in the second row 32, with the plug in the position shown in FIG. 2. The outer cylindrical surface of plug 14 prevents the top pins T which are within cylinder holes 34, 36, 38, 40 from protruding downwardly in response to the pressure from springs 38. Initially, there are no middle pins in the cylinder holes 34, 36, 38, 40, but as will be described below, it is possible to move some of the middle pins M shown in FIG. 3B to the cylinder holes 34, 36, 38, 40 shown in FIG. 3A.

Figure 3C:
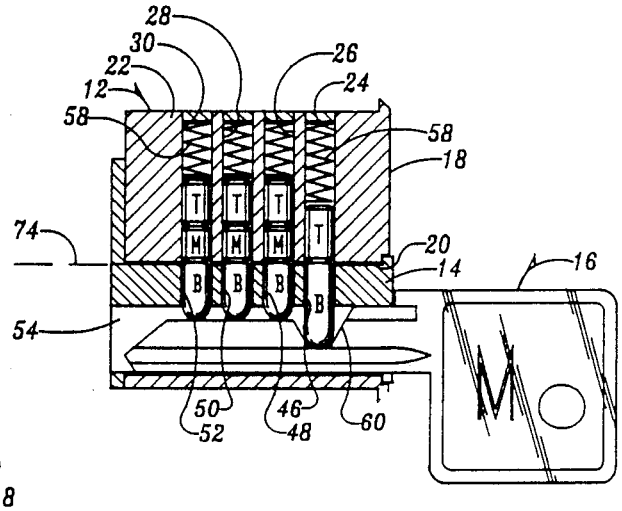
FIGS. 3C–3F are views similar to 3B, but showing various types of keys used in the keyway.

FIG. 3C shows master key 16 having a master notch 60 therein which is in registered alignment below cylinder hole 24. This slot 60 causes the bottom pin B in plug hole 46 to join the top pin T in cylinder hole 34 so that the juncture between the two is exactly at the outer cylindrical surface of plug 14.

The remainder of key 16 engages the bottom pins B in plug holes 48, 50, 52 so as to urge them upwardly and so as to urge the middle pins M from the position shown in FIG. 3B to the position shown in FIG. 3C. In this position, the junctures between middles pins M and bottom pins B coincides with the outer cylindrical surface of plug 14. This line along the outer cylindrical surface of plug 14 is referred to as a break line or shear line and is designated by the numeral 74. Since all of the junctures between the pins lie upon break line 74, it is possible to rotate master key 59 when it is in the position shown in FIG. 3C.

Figure 3D:
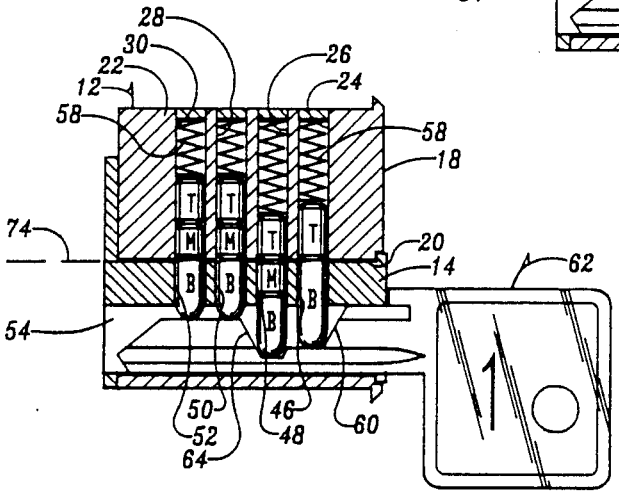
Figure 3E:
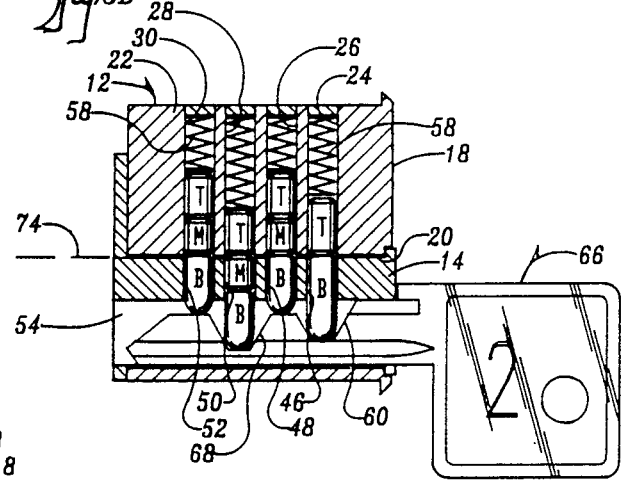
Figure 3F:
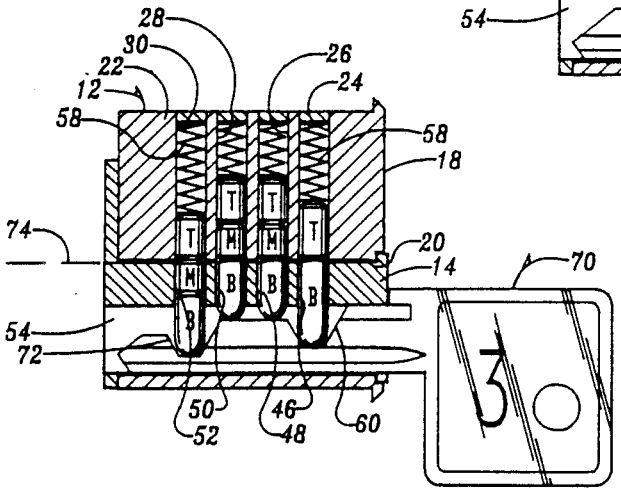

In some applications such as an office safe or security compartment, it is desirable to have more than one key which will operate the particular lock. FIGS. 3D, 3E, and 3F show three coded keys 62, 66, 70 which can be used to open the lock shown in FIG. 2. First code key 62 includes a slot 60 identical to slot 60 in the master key 16. In addition to this, code key 62 includes a first code notch 64 located in registered alignment with cylinder hole 26 and plug hole 48. The spring 58 causes the top pin, middle pin, and bottom pin in cylinder hole 36 to be urged downwardly so that the middle pin lies completely within plug hole 48 and the juncture between the middle pin and the top pin lies on the break line 74. In this arrangement, it is possible for first code key 62 to operate the lock.

Second code key 66 is similar to code key 62, but it includes a second code notch 68 positioned in registered alignment with cylinder hole 28 and plug hole 50. This causes the middle pin M to be positioned completely within plug hole 50 and places the junctures between the pins all on break line 74.

Third code key 70 is similar to keys 62, 66 with the exception that it includes a third code notch 72 aligned with cylinder hole 30 and plug hole 52. The middle pin M in cylinder hole 30 is urged downwardly so that it is completely within plug hole 52 as shown in FIG. 3F, with the junctures of all the various pins being located on the shear line 74.

Figure 4:
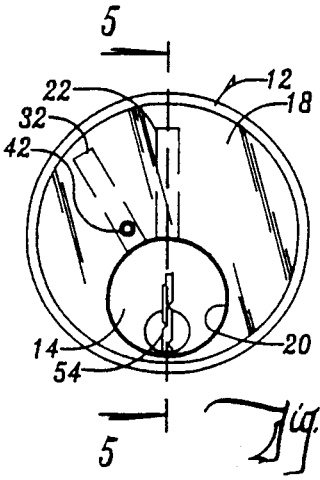
FIG. 4 is a view similar to FIG. 2.
Figure 5:
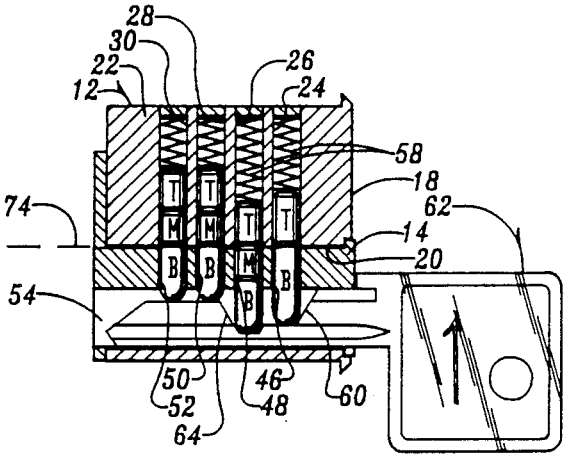
FIG. 5 is a sectional view taken along line 5–5 of FIG. 4, but showing a first code key in the lock.
Figure 6:
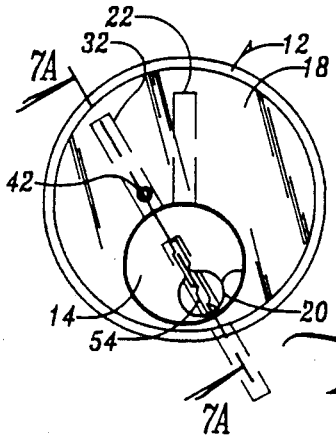
FIG. 6 is a view similar to FIG. 4.

FIGS. 4 through 9C illustrate the manner in which the coding can be changed within the main cylinder channel 22. FIG. 5 illustrates the first code key 62 inserted within keyway 54 with the keyway aligned vertically as shown in FIG. 4. In this position, code key 62 is free to rotate from its first position aligned with cylinder row 22 to its second position aligned with the cylinder holes of row 32. FIG. 7A illustrates first code key 62 after it has been rotated counterclockwise into alignment with row 32 as illustrated in FIG. 6. It should be noted that in moving from the position shown in FIG. 5 to the position shown in FIG. 7A, the plug 14 carries with it the middle pin M which was originally contained within cylinder hole 26 of first row 22. Thus, after rotation to the second position of FIG. 7A, the middle pin M has been realigned with cylinder hole 36 of the second row 32.

Figure 7A:
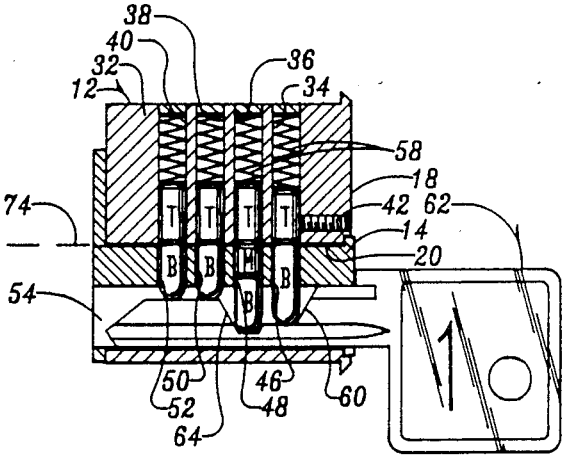
FIG. 7A is a sectional view taken along line 7A–7A of FIG. 6, and showing a coded key in the lock.
Figure 7B:
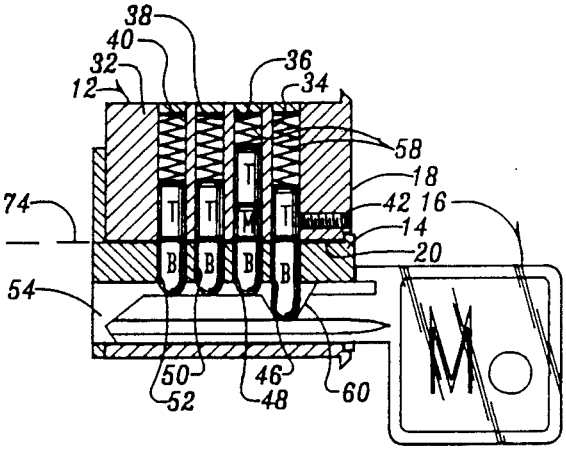
FIG. 7B is a view similar to FIG. 7A, but showing a master key in the lock.

After first code key 62 has been moved to the position of FIG. 7A, it is removed from keyway 54, and the master key 16 is inserted in its place as shown in FIG. 7B. The master key 59 forces the middle pin M upwardly into cylinder hole 36 of second row 32. The master key 16 is next used to rotate the plug 14 in a clockwise direction back to its first position in alignment with cylinder rows 32.

Figure 8:
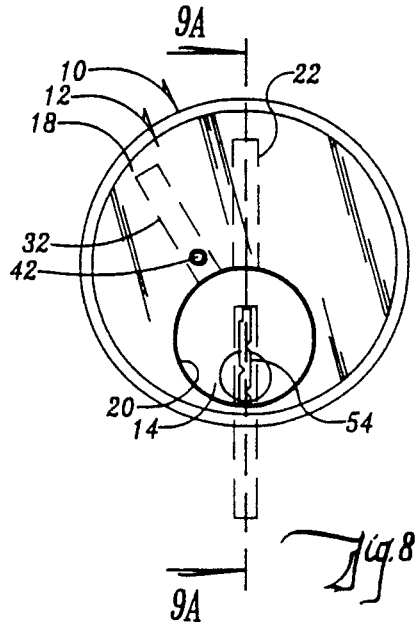
FIG. 8 is a view similar to FIGS. 4 and 6.
Figure 9A:
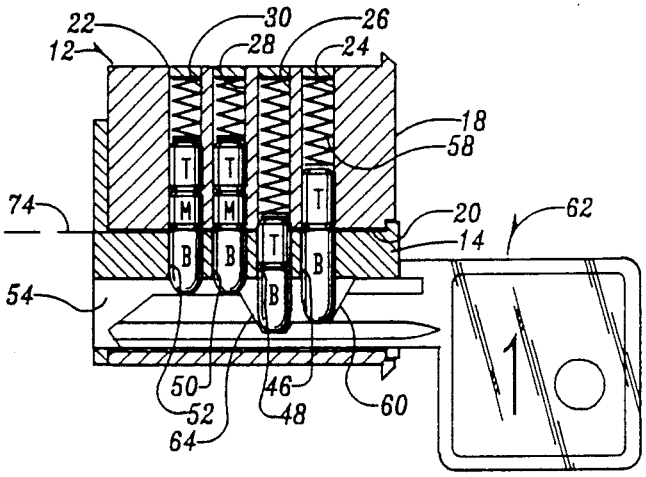
FIG. 9A is a sectional view taken along line 9A–9A of FIG. 8, and showing a first coded key in the lock.
Figure 9B:
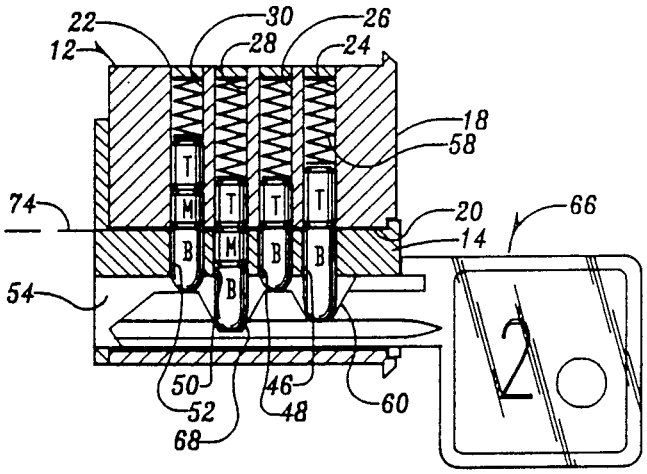
FIG. 9B is a view similar to FIG. 9A and showing a second coded key in the lock.
Figure 9C:
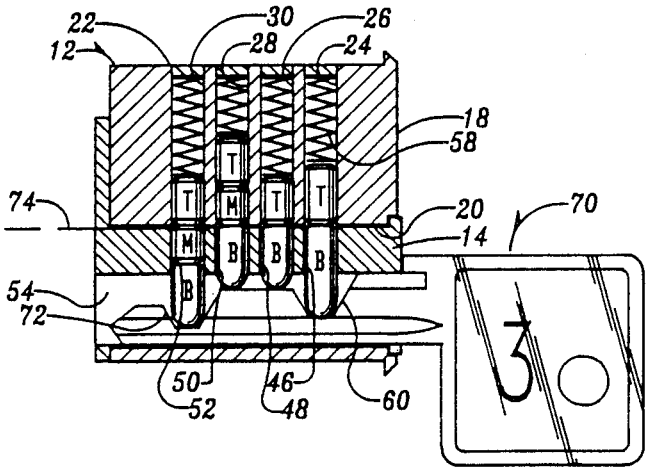
FIG. 9C is a view similar to FIGS. 9A and 9B, and showing a third coded key in the lock.
Figure 10:
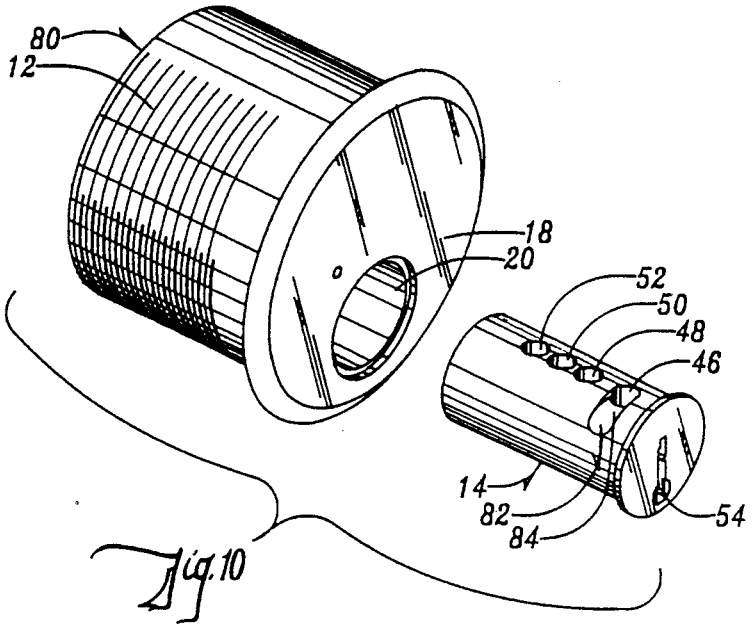
FIG. 10 is a perspective view of a further modification of the present invention.
Figure 11:
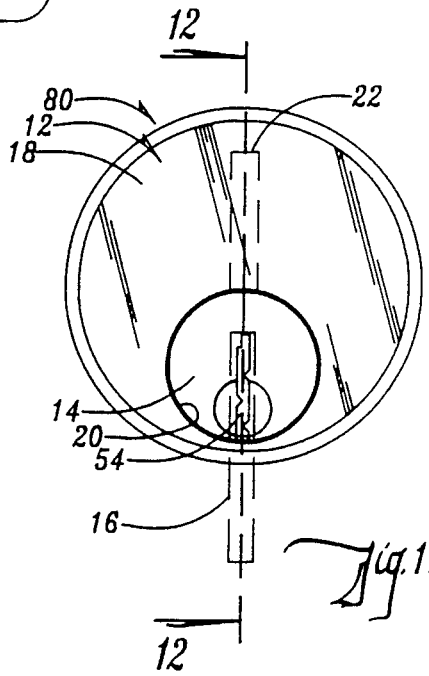
FIG. 11 is a front elevational view of the device of FIG. 10.

FIGS. 8–9C illustrate the manner in which the first row 22 of cylinder holes has been recoded by virtue of the abovedescribed procedure. FIG. 9A illustrates what happens when first code key 62 is inserted into the keyway 54. Since the middle pin M has been moved from cylinder row 22 to cylinder row 36, the top pin T in cylinder row 26 protrudes downwardly into the plug 14 as illustrated in FIG. 9A. As can be seen in FIG. 9A, the top pin spans the shear line 74, and therefore prevents the rotation of plug 54. Thus, by moving the middle pin M from row 26 to row 36 as described and shown in FIGS. 4–7B, it is possible to recode the cylinder row 22 so that code key 62 will not operate the lock. FIGS. 9B and 9C illustrate that the second and third code keys 66, 70 are still operable to rotate and operate the lock. However, it is possible to use the same procedure for code keys 66 and 70 so as to render them inoperable. In order to do so, the procedure shown in FIGS. 47–7B is repeated, using either code key 66 or code key 70 in the place of code key 62.

The device 10 shown in FIGS. 1–9C is particularly applicable for use with a safe or security box, wherein a number of persons have access to the box. The number of keys which will operate the box can be decreased by following the procedures shown in FIGS. 4–7B. Similarly, the number can be increased merely by reversing the procedure shown in FIG. 7B so as to move the appropriate middle pin M from the second row 32 back to the first row 22 of cylinder holes.

After the desired code combination has been set for the first cylinder row 22, the set screw 42 is tightened against the top pin T as is illustrated in FIG. 3A. This prevents the top pin T from rising upwardly in cylinder hole 34 of second row 32. Thus, when either the master key M or any of the code keys are rotated to their second position in alignment with second row 32, it is not possible to remove the keys from the keyway. For example, in FIG. 7A, the master key 59 cannot be removed from the keyway if the top pin T in row 34 will not slide upwardly to permit the bottom pin B from sliding up out of the master notch 60. This same situation occurs when one of the code keys such as code key 62 is positioned as shown in FIG. 7A. The set screw 42 prevents the top pin T and consequently the bottom pin B from moving upwardly, and therefore, prevents the removal of key 62.

When it is desired to reset the combination, the set screw 42 is loosened so as to permit the removal of the code keys and the master key when in the second position in alignment with second row 32.

Referring now to FIGS. 10–15, a modified lock 80 is shown. Lock 80 is identical to the lock 10 shown in FIG. 1 with the exception that the plug 14 includes an elongated circumferentially extending notch 82 adjacent the plug hole 46. Notch 82 includes a floor surface 84 (FIG. 13) which commences adjacent plug hole 46 and which tapers radially outwardly until it joins the outer cylindrical surface of plug 14. This creates a shoulder 86 formed against the right hand edge of plug hole 46 as viewed in FIG. 13.

Figure 12:
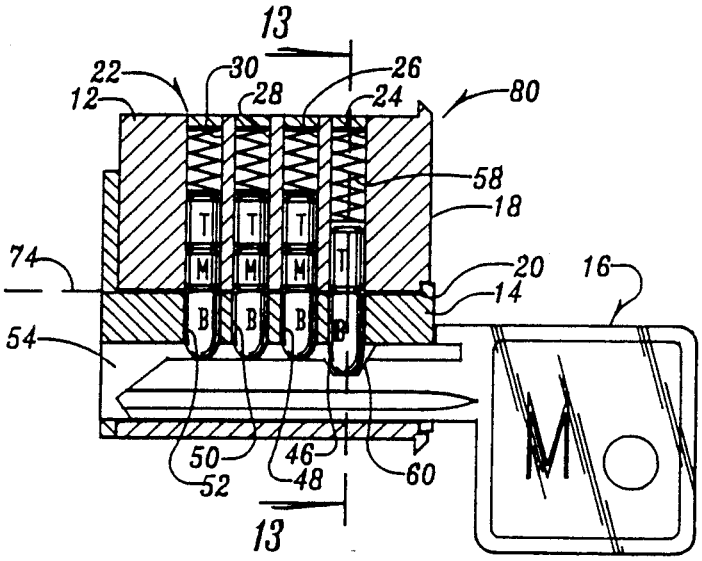
FIG. 12 is a sectional view taken along line 12–12 of FIG. 13 showing a master key in the lock.
Figure 13:
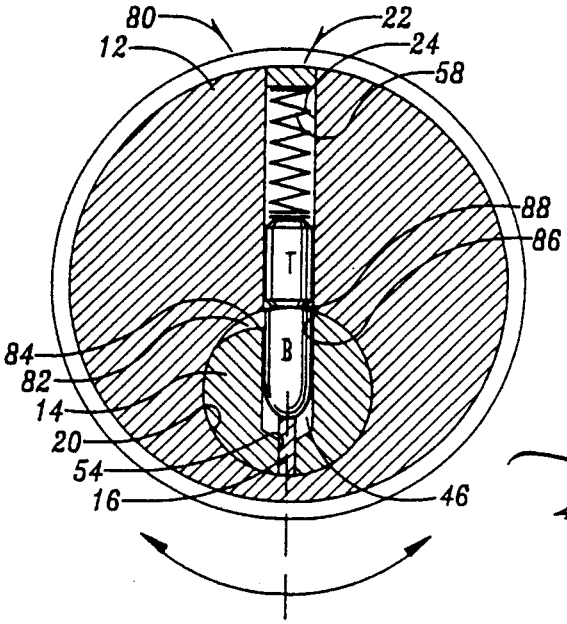
FIG. 13 is a sectional view taken along line 13–13 of FIG. 12.

Notch 82 permits the device to be used with a master key 16 which will generally operate the lock at all times. As can be seen in FIG. 12, all of the junctures between the bottom pins B and the other pins fall on the shear line 74 so that the key 16 can operate the lock. FIG. 13 shows the juncture 88 between the top pin T and the bottom pin B in the registered cylinder hole 24 and the plug hole 46.

Figure 14:
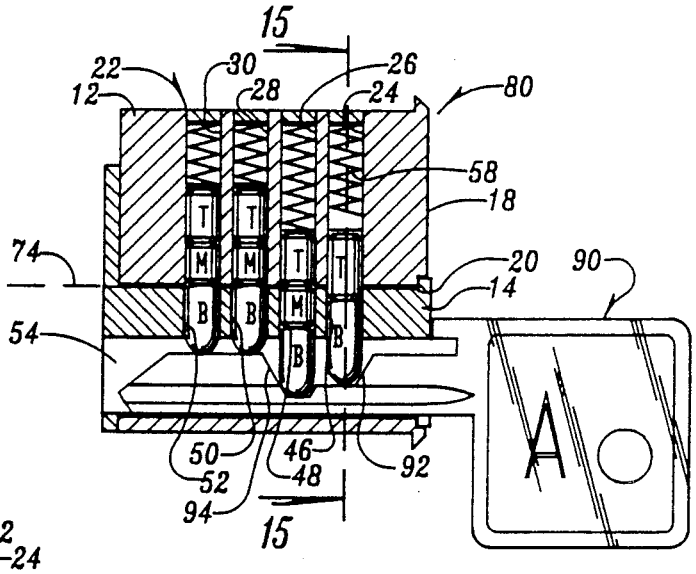
FIG. 14 is a view similar to FIG. 12, but showing an access key therein.
Figure 15:
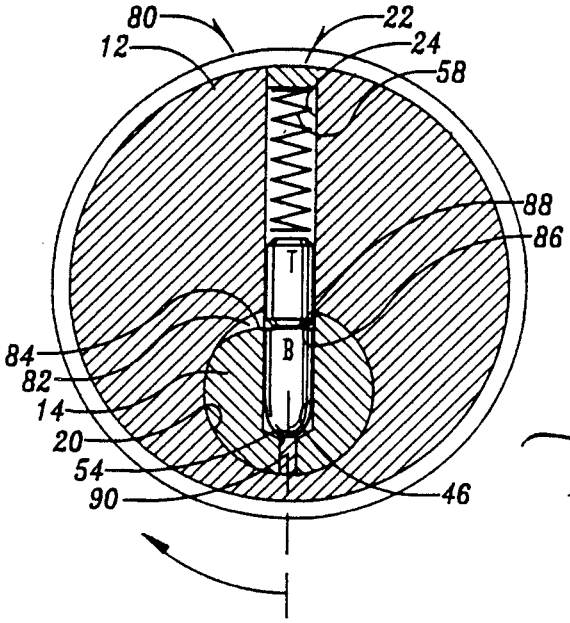
FIG. 15 is a sectional view taken along line 15–15 of FIG. 14.
Figure 16:
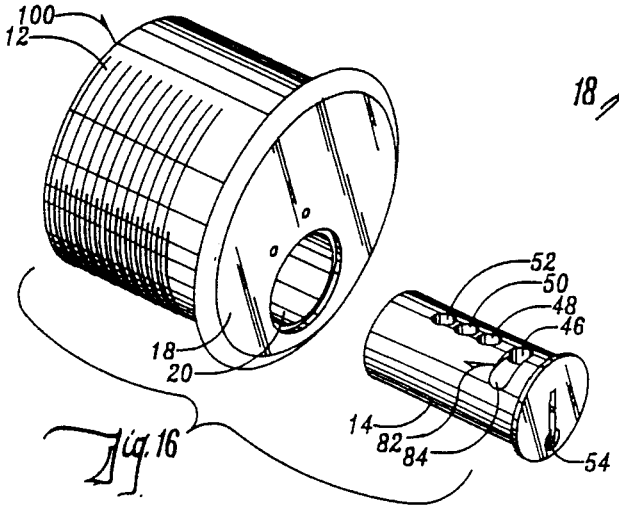
FIG. 16 is an exploded perspective view of a further modification of the present invention.
Figure 17:
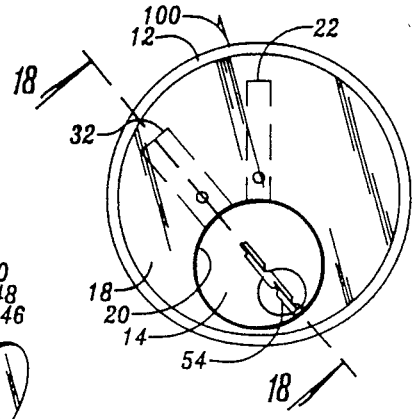
FIG. 17 is a front elevational view of the device shown in FIG. 16.

In some situations however, it is desirable to provide a special key 90 which is capable of locking the lock, but which is incapable of unlocking the lock. This key 90 is illustrated in FIG. 14. The notch 92 in key 90 is chosen so that the juncture 88 between the top pin T and the bottom pin B coincides with the floor 84 of the notch 82 as is illustrated in FIG. 15. This permits key 90 to rotate plug 14 in a clockwise direction, but the shoulder 86 engages the top pin T within cylinder hole 24 to prevent rotation of the plug 14 in a counterclockwise direction. Thus, the user of the key 90 can rotate the lock in one direction to put it in a locking position, but cannot operate the lock in the opposite direction to open the lock once it is locked.

Figure 18:
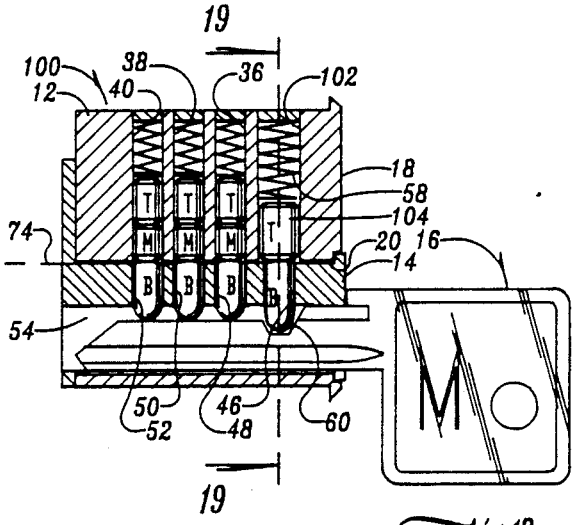
FIG. 18 is a sectional view taken along line 18–18 of FIG. 17.
Figure 19:
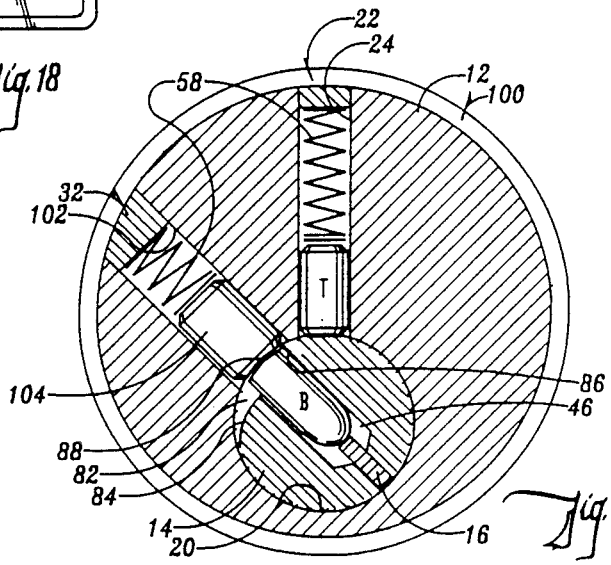
FIG. 19 is a sectional view taken along line 19–19 of FIG. 18.
Figure 20:
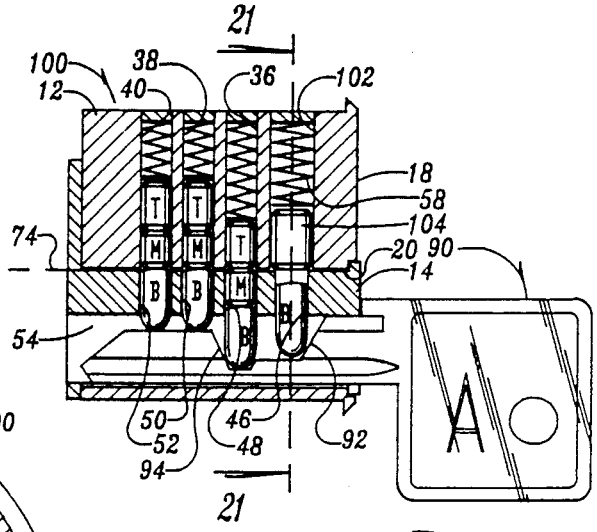
FIG. 20 is a sectional view similar to FIG. 18, but showing a coded key therein.

Referring to FIG. 16–20, a further modification 100 of the lock is shown. Lock 100 is identical to lock 80 with the exception that the second row 32 of cylinder holes includes an enlarged cylinder hole 102 therein as is illustrated in FIGS. 18, 19, and 20. This enlarged cylinder hole 102 includes an enlarged top pin 104 which has a diameter larger than the corresponding plug hole 46. Thus, pin 104 is incapable of sliding downwardly into the plug hole 46.

This arrangement permits the use of an access key 90 which is capable of opening the lock a single time after it has been locked. However, after the access key 90 has unlocked the lock once, it is no longer possible to unlock the lock, but key 90 can still be used to move the lock to its locked position.

FIGS. 18 and 19 illustrate the operation of the device when master key 16 is used. It should be noted that master key 16 is shown in FIG. 18 to be a blank key having only notch 60 therein. However, the key 16 can be coded in any manner which when coordinated with any appropriate pins will enable the key 16 to operate the lock.

FIG. 19 illustrates the master key 16 in its second position aligned with second row 32 of the cylinder holes. In this position, the bottom pin B within plug 14 engages the enlarged pin 104. If the master key 16 is removed from the keyway in this position, the enlarged pin 104 will cam upwardly into enlarged cylinder hole 102 so as to permit removal of the master key.

When the owner of the master key wants to provide access to another person having an access key 90, the owner places the master key in the position shown in FIG. 19 and removes the master key, thereby leaving the plug 14 in its second position with plug holes 46, 48, 50, 52 aligned with row 32 of the cylinder holes.

Figure 21:
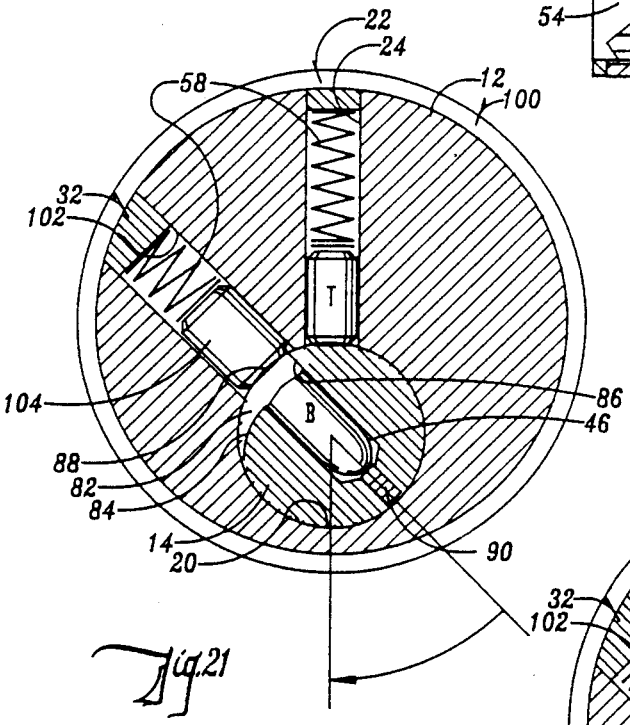
FIG. 21 is a sectional view taken along line 21–21 of FIG. 20.
Figure 22:
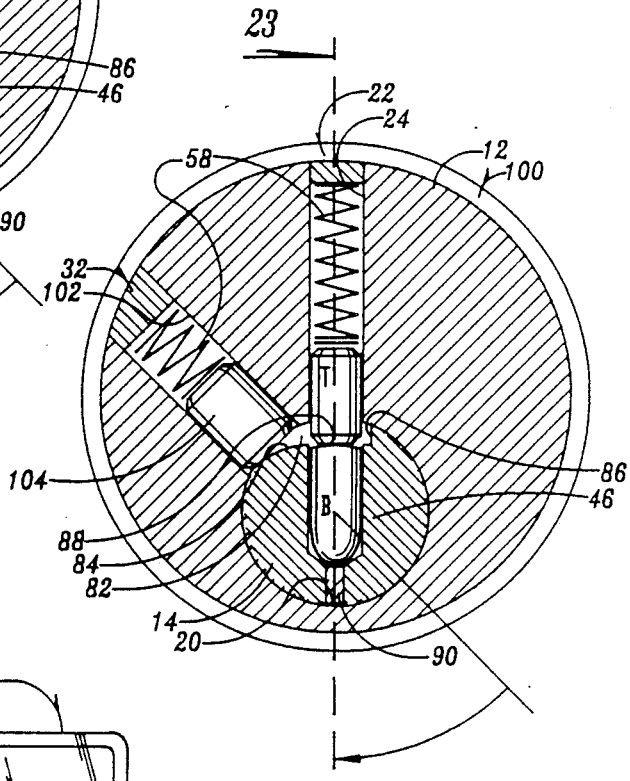
FIG. 22 is a sectional view similar to FIG. 21, but showing the plug rotated to a different position.
Figure 23:
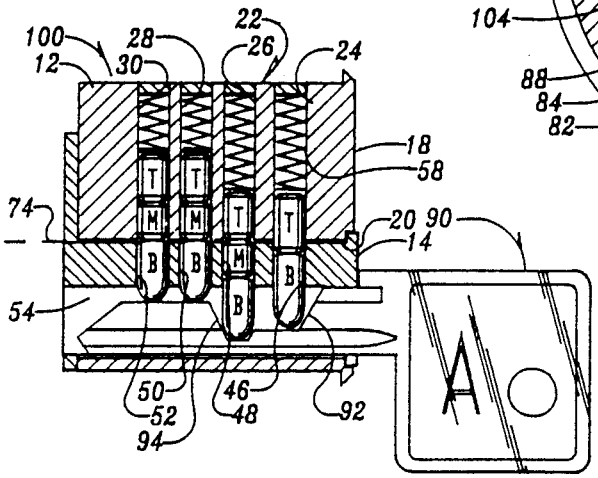
FIG. 23 is a sectional view taken along line 23–23 of FIG. 22.

The person with the access key 90 can then insert the key 90 into the keyway as illustrated in FIG. 20. In this position, the pin 104 is prevented by virtue of its size from extending downwardly into the plug hole 46. Thus, the key 90 is free to rotate plug 14 in either a clockwise or a counterclockwise direction. FIG. 21 illustrates the position of the key 90 when the plug 14 is in its second position. The key may be rotated in a counterclockwise direction to unlock the lock and it may then be rotated in a clockwise direction to lock the lock. As the key is rotated to the right or clockwise to lock the lock, it reaches the vertical position shown in FIG. 22 at which time the one top pin T within cylinder hole 24 drops downwardly into engagement with bottom pin B as illustrated in FIG. 22. In this position, the juncture 88 between top pin T and bottom pin B coincides precisely with the floor 84 of notch 82. The shoulder 86 of notch 82 engages the top pin and prevents the plug from any further rotation in a counterclockwise direction. This is also illustrated in FIG. 23.

Thus, when the master key is removed leaving the plug in its second position, the access key 90 can be used to rotate the lock in a counterclockwise direction to unlock the lock. However, when the access key is rotated clockwise to close the lock, it is prevented from returning in a counterclockwise direction by virtue of the shoulder 86 as is illustrated in FIGS. 22 and 23.

Figure 24:
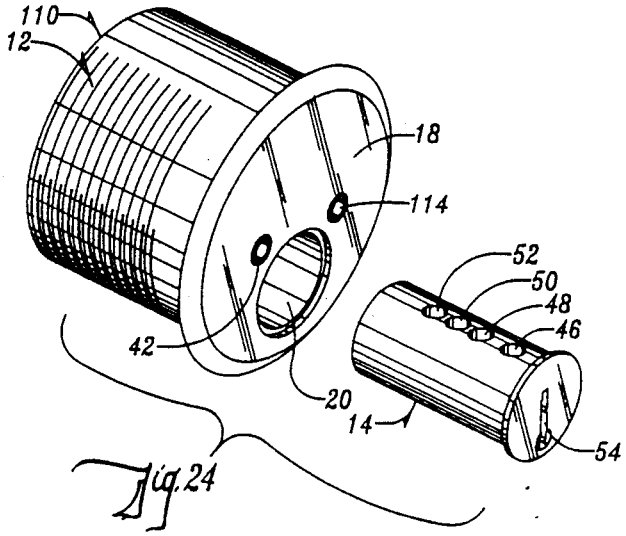
FIG. 24 is an exploded perspective view of another modified form of the present invention.
Figure 25:
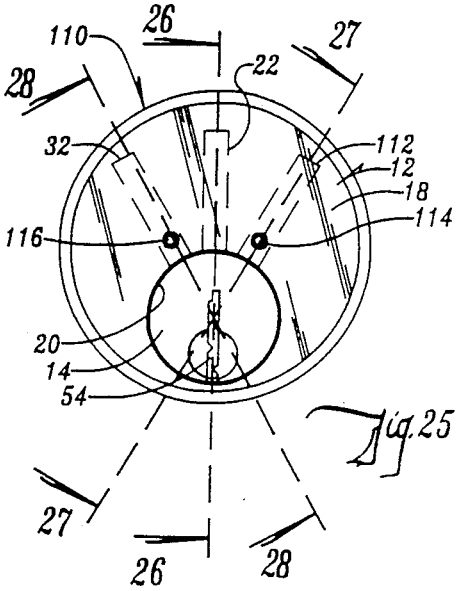
FIG. 25 is a front elevational view thereof.
Figure 26:
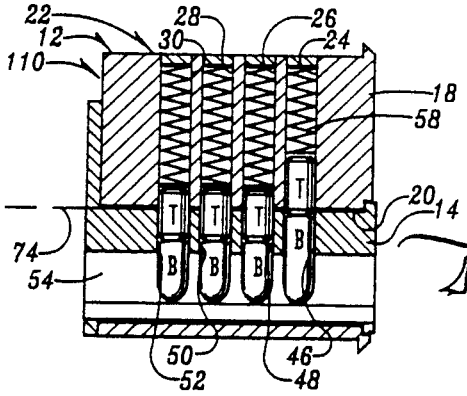
FIG. 26 is a sectional view taken along line 26–26 of FIG. 25.
Figure 27:
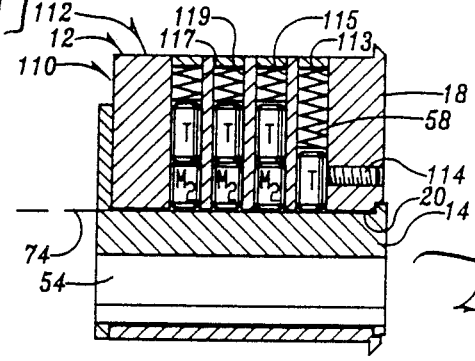
FIG. 27 is a sectional view taken along line 27–27 of FIG. 25.
Figure 28:
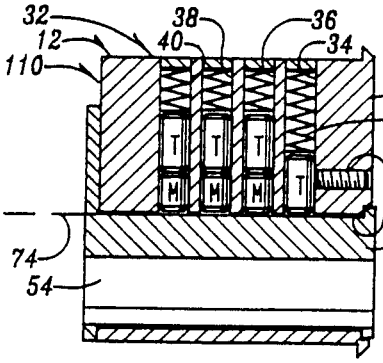
FIG. 28 is a sectional view taken along line 28–28 of FIG. 25.

FIGS. 24–37 illustrate a further modification of the present invention which is generally designated by the numeral 110. Lock 110 of FIG 24 is identical to lock 10 of FIG. 1 with the exception that the cylinder housing 12 includes a third row 112 of cylinder holes 113, 115, 117, 119 and includes a second set screw 114 associated therewith. Third row 112 is illustrated in FIG. 27. It includes a plurality of top pins T, and it includes three middle pins M2 which are of a different size than the middle pins M located within second row 32. In the initial uncoded condition, the three rows of the lock 112, 22, and 32 appear as shown in FIGS. 26, 27, and 28. The row 112 includes the middle pins M2, and the second row 32 includes the middle pins M. The middle row 22 initially includes no middle pins, but includes only top pins and bottom pins.

Figure 29:
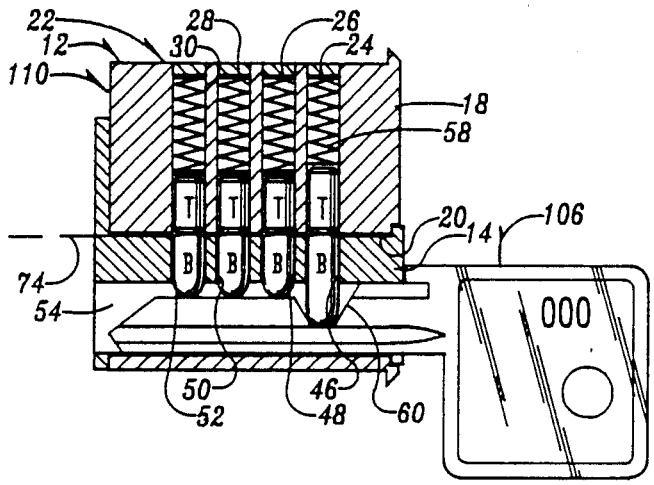
FIG. 29 is a sectional view of a key coded 000 within the slot.
Figure 29A:
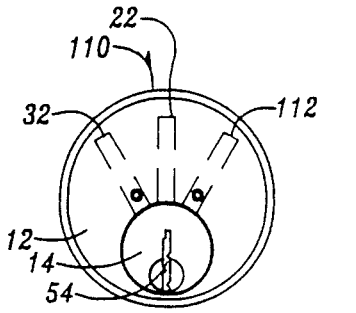
FIG. 29A is a schematic drawing showing the rotational position of the key in FIG. 29.
Figure 30:
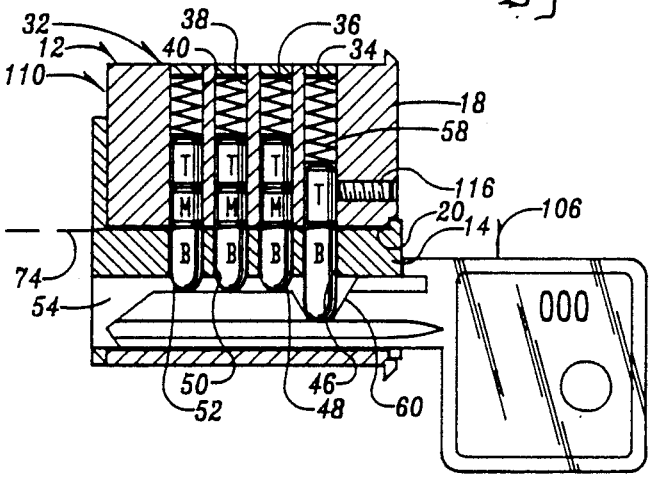
FIG. 30 is a sectional view similar to FIG. 29.
Figure 30A:
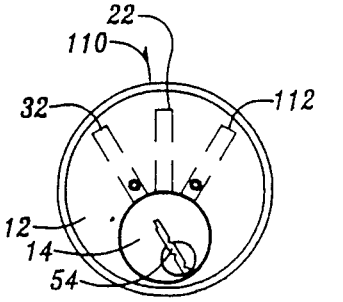
FIG. 30A is a schematic view showing the rotational position of the key in FIG. 30.
Figure 31:
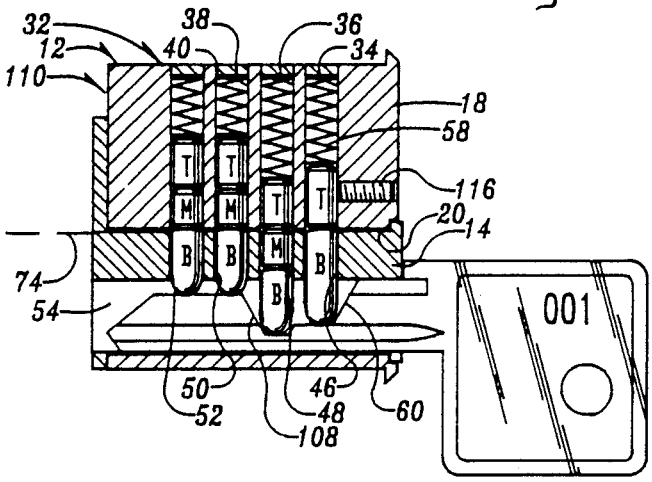
FIG. 31 is a sectional view showing a key coded 001.
Figure 31A:
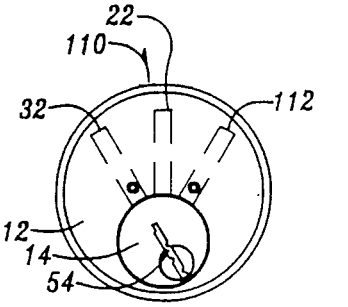
FIG. 31A is a schematic view showing the rotational position of the key in FIG. 31.
Figure 32:
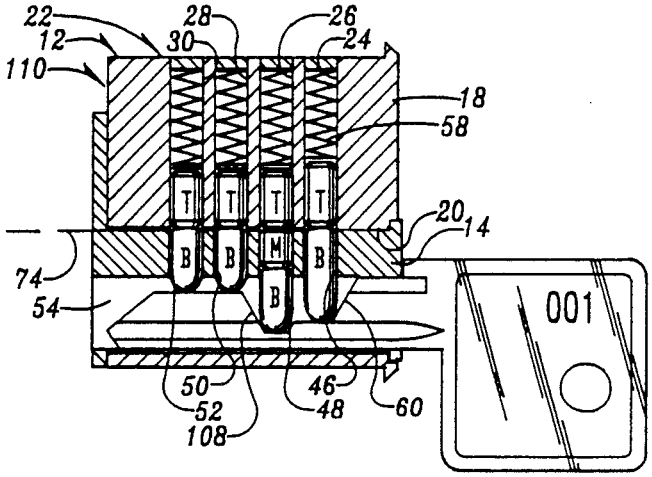
FIG. 32 is a sectional view similar to FIG. 31.
Figure 32A:
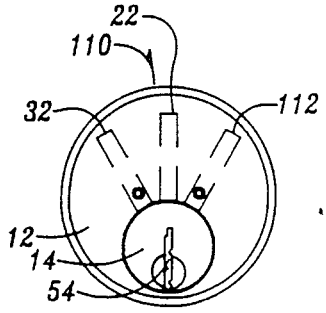
FIG. 32A is a schematic view showing the rotational position of the key in FIG. 32.
Figure 33:
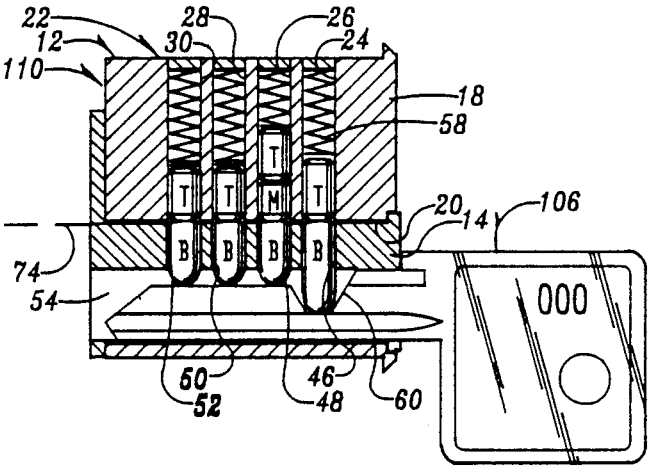
FIG. 33 is a sectional view of a key coded 000.
Figure 33A:
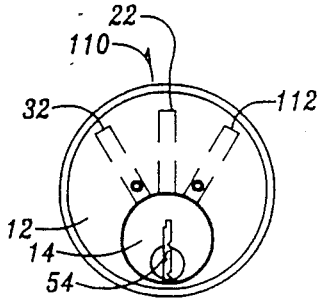
FIG. 33A shows the rotational position of the key in FIG. 33.
Figure 34:
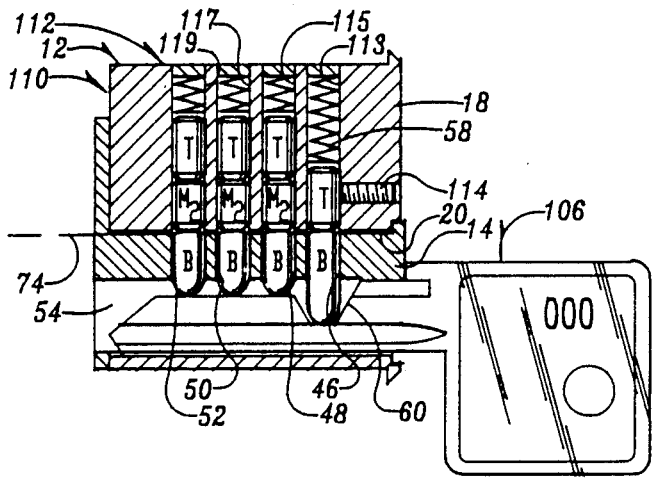
FIG. 34 is a sectional view of the key coded 000.
Figure 34A:
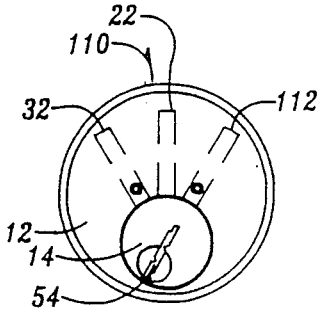
FIG. 34A is a schematic view showing the rotational position of the key in FIG. 34.
Figure 35:
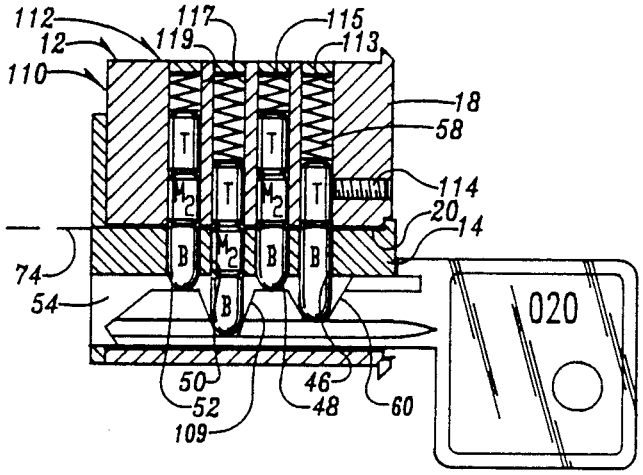
FIG. 35 is a sectional view of a key coded 020.
Figure 35A:
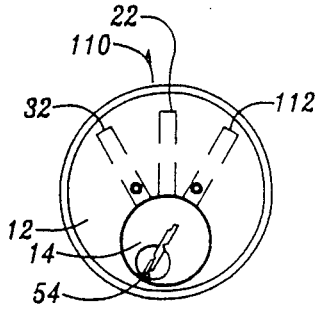
FIG. 35A is a schematic view showing the rotational position of the key in FIG. 35.
Figure 36:
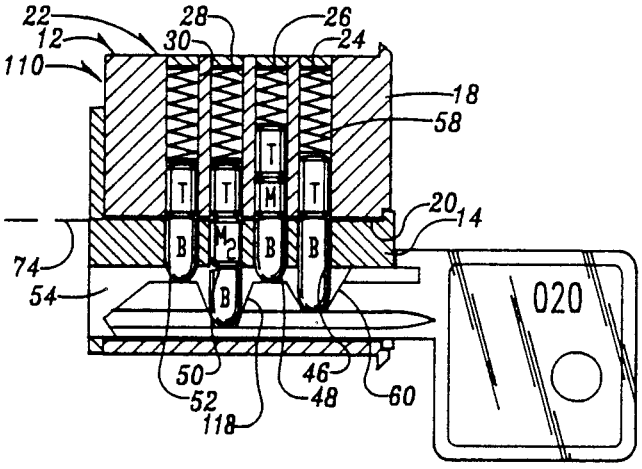
FIG. 36 is a sectional view showing a key coded 020.
Figure 36A:
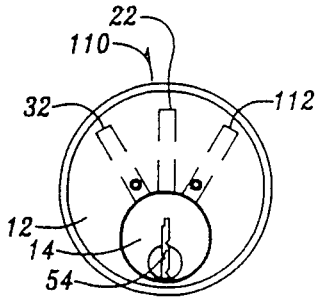
FIG. 36A is a schematic view showing the rotational position of the key of FIG. 36.

FIGS. 29–37 illustrate the procedure for coding the cylinder row 22 with a predetermined code. Initially, a blank or zero key 106 is inserted into the keyway while the keyway is in its vertical position as illustrated in FIG. 29. The key 106 is then rotated in a counterclockwise direction until it is aligned with the row 32 of cylinder holes containing the middle pins M, as illustrated in FIG. 30. The blank key 106 is then removed, and a first code key 001 is inserted into the keyway. Key 001 includes a coded notch 108 which permits the middle pin M in one of the cylinder rows to drop downwardly into the plug hole 46 of plug 14. Key 001 is then moved clockwise to the vertical position as is illustrated in FIGS. 32, 32A. In this position, the middle pin M has been carried into alignment with the cylinder hole 26. Key 001 is then removed, and the blank key 106 is again inserted. Blank key 106 causes middle pin M to be forced upwardly into the cylinder hole 26. The master key is then rotated to the right or clockwise into alignment with the third row 112 of cylinder holes. FIGS. 34, 34A illustrate the blank key in this position. The blank key 106 is then removed and a second code key bearing the code 020 is inserted as illustrated in FIGS. 35, 35A. Code key 020 has a notch 109 sized to permit the middle pin M2 to drop downwardly into the corresponding plug hole 50 of plug 14. Code key 020 is then rotated in a counterclockwise direction back to its vertical position as illustrated in FIGS. 36, 36A. In this position, middle pin M2 has been carried into alignment with cylinder hole 28. Key 020 is then removed from the keyway, thereby leaving first row 22 of the cylinder holes with middle pin M in row 26 and with middle pin M2 in row 28. The set screws 46, 114 are then tightened so as to prevent removal of any keys when the lock is turned into alignment with either row 32 or row 112.

Figure 37:
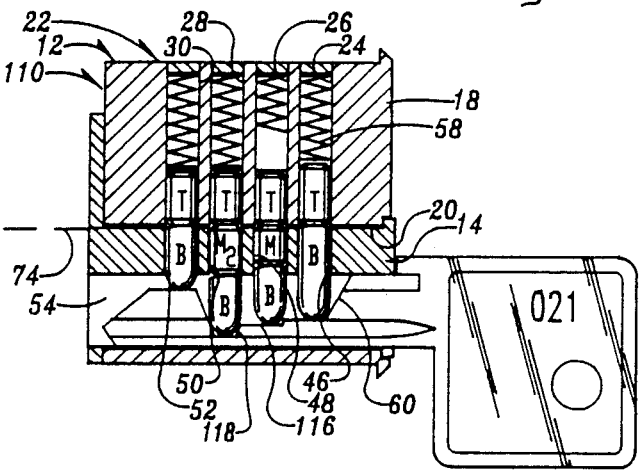
FIG. 37 is a sectional view showing a key coded 021.
Figure 37A:
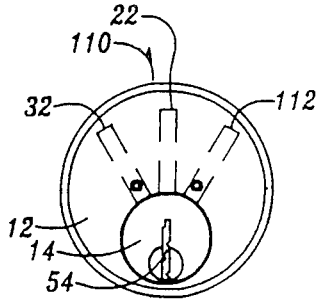
FIG. 37A is a schematic view showing the rotational position of the key in FIG. 37.

The lock is now coded to accommodate a key 021 as illustrated in FIGS. 37, 37A. Key 021 includes a standard notch 60 similar to that found in all of the master keys. In addition, key 021 includes a first code notch 116 and a second code notch 118 which will permit the middle pins M2 and M to drop downwardly into the plug holes so that the junctures between pin M2 and the top pin T, and the juncture between middle pin M and the top pin T coincide with the shear line 74. Thus, as is illustrated in FIG. 37, all of the junctures of the pins lie on shear line 74, and the key 021 can be utilized to operate the lock.

In many applications such as apartment houses, it is often desirable to change the code to the lock when one tenant leaves an apartment or for other reasons. To do so is a simple operation with the present invention, in that all that is necessary is to use appropriate code keys to transfer the middle pins M and the middle pins M2 into the desired combination within first row 22. Since middle pin M and middle pins M2 are of different sizes, it is possible to achieve a very large number of permutations in combinations for coding the first row 22. While the drawings have illustrated only four holes in the cylinder rows 22, 32, 112, it is possible to increase the number of permutations and combinations in codes which can be achieved by increasing the number of holes in each row. The number of holes can be changed without adding or detracting from the present invention.

Figure 38:
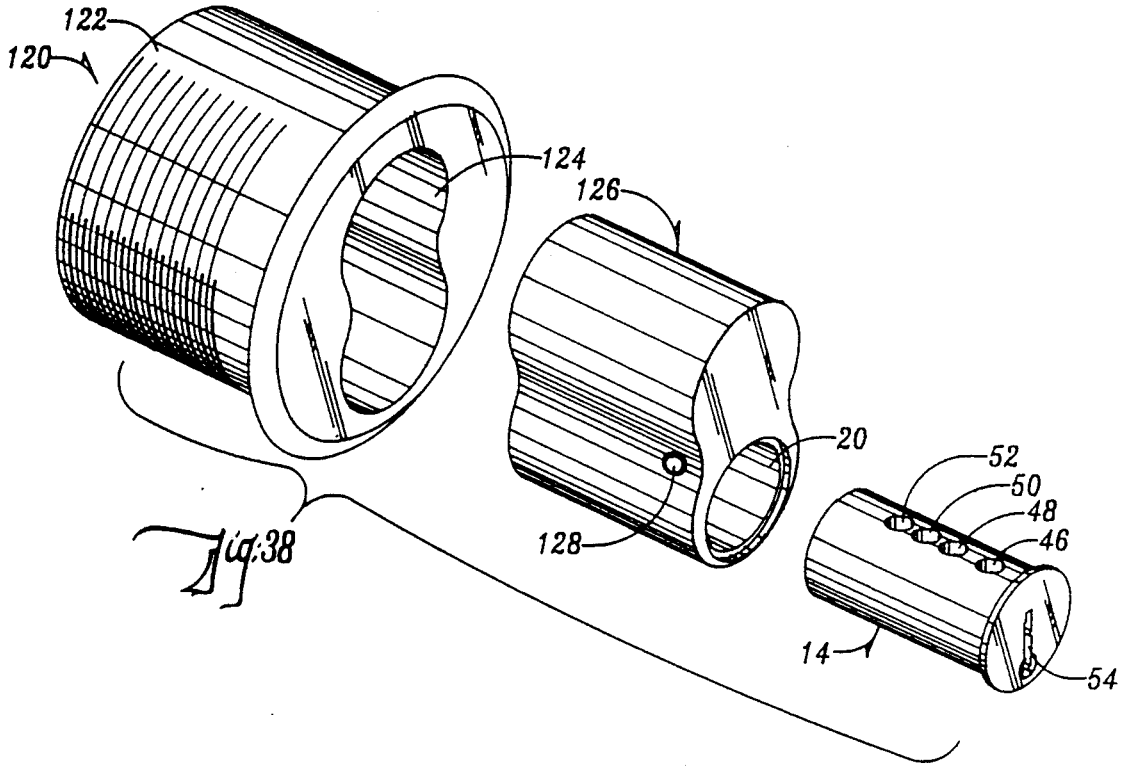
FIG. 38 is an exploded perspective view of a modified form of the invention.
Figure 39:
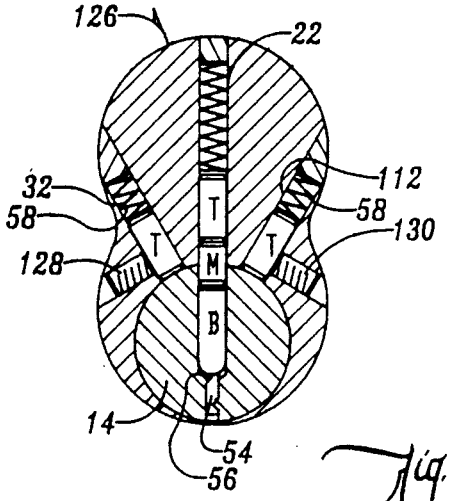
FIG. 39 is a sectional view of the device shown in FIG. 38.

Referring to FIGS. 38 and 39, a modified form of the invention 120 is shown. Device 120 includes an outer housing 122 having a figure eight shaped bore 124 extending therethrough. Slidably fitted within bore 124 is a cylinder housing 126 having a corresponding figure eight configuration. Plug 14 is then slidably fitted within a cylindrical bore 20 extending into housing 126. The use of a figure eight housing 126 commonly occurs in the art, and key systems (not shown) are normally provided for locking or unlocking the housing 126 in the figure eight bore 124.

Extending inwardly from the lateral sides of housing 128 are two set screws 128, 130 which extend inwardly and engage the first cylinder hole in rows 32, 112 respectively of the cylinder holes provided in housing 126. The positioning of the set screws 128 on the sides of the housing 126 permits them to be hidden from access when the housing 126 is within the bore 124. Thus, it is not possible for persons to unlock these set screws and recode the key without first having the key to permit the removal of the housing 126.

FIG. 39 illustrates the use of the three cylinder row modification previously illustrated in FIG. 24. However, the other modifications illustrated in FIGS. 1, 10, and 16 can also be used with this structure; the primary advantage being that the set screws 128, 130 are hidden from access after the lock has been coded.

Thus, it can be seen that the device accomplishes all of its stated objectives.

I claim:

1. A cylinder lock comprising:

a cylinder housing having a front axial end, a rear axial end, and an elongated cylindrical bore therein, said bore having a cylindrical axis, said housing having at least first and second rows of cylinder holes therein extending along the length of said bore, said first row being circumferentially spaced from said second row with respect to said cylindrical axis of said bore;

each of said cylinder holes of said first and second rows having an inner end in communication with said cylindrical bore and extending radially outwardly therefrom;

a cylindrical plug rotatably disposed in said bore and having a front end adjacent said front axial end of said housing, a plurality of plug holes extending along the length thereof, said plug having an outer cylindrical plug surface, said plug holes having inner ends and having outer open ends extending along a line on said outer cylindrical plug surface;

said plug being rotatable from a first position wherein said outer open ends of said plug holes are in registration with said inner open ends of said first row of said cylinder holes to a second position wherein said outer open ends of said plug holes are in registration with said inner open ends of said second row of said cylinder holes;

said plug having an elongated keyway extending longitudinally therein and being in communication with said inner ends of said plug holes, said keyway having an open end at said front end of said plug;

each of said cylinder holes in said first and second rows having a top pin slidably mounted therein and having spring means yieldably urging said top pin radially inwardly;

each of said plug holes having a bottom pin slidably mounted therein;

a plurality of middle pins within at least some of said cylinder holes, each of which is capable of being slidably retained within one of said plug holes and positioned radially outwardly from said bottom pin within said one plug hole;

at least one coding key which is insertable into said keyway when said plug is in said first position, said one coding key causing a first group of said middle pins to be forced radially outwardly into at least some of said cylinder holes of said first row and causing a second group comprising at least one of said middle pins to remain in said plug holes;

said one coding key being operable when in said keyway to rotate said plug to said second position and to carry said second group of middle pins in said plug into registered alignment with some of said cylinder holes in said second row;

said one coding key being removable from said keyway when said plug is in said second position;

a master key insertable into said keyway when said plug is in said second position, and being adapted to cause said second group of middle pins to be forced radially outwardly into some of said cylinder holes of said second row;

said master key being operable to permit rotation of said plug from said second position to said first position whereby said second group of middle pins remain in said second row of cylinder holes and said first group of middle pins remain in said first row of cylinder holes;

said one coding key being inoperable to rotate said plug from said first position to said second position when said second group of said middle pins are within said second row of said cylinder holes;

locking means being provided within said cylinder housing, said locking means having a first end adjacent to said front axial end of said housing and having a second end within said housing adjacent one of said top pins of one of said cylinder holes of said second row, said locking means being movable from an unlocked position, wherein said second end of said locking means is spaced from said one top pin within said one cylinder hole in said second row to a locked position wherein said second end frictionally retentively engages said one top pin in said one cylinder hole to prevent longitudinal sliding of said one top pin within said one cylinder hole whereby said master key and said coding key are prevented from removal from said keyway when said plug is in said second position and said locking means is in said locked position.

2. A cylinder lock according to claim 1 comprising a plurality of coding keys in addition to said one coding key, each of said coding keys having a unique shape adapted to force a corresponding unique combination of said middle pins into at least some of said cylinder holes when inserted into said keyway, all of said coding keys being capable of rotating said plug when all of the corresponding unique combinations of middle pins are in said first row of said cylinder holes, each of said coding keys being inoperable to rotate said plug when its corresponding unique combination of said middle pins having been moved to said second row of said cylinder holes.

3. A lock according to claim 1 wherein a slot is formed in said cylindrical plug surface adjacent a first one of said plug holes, said slot having a first slot end commencing at said one plug hole and extending in a circumferential direction therefrom to a second slot end, said slot having a slot floor which is spaced radially inwardly from said cylindrical plug surface adjacent said first slot end and which is approximately coincident with said cylindrical plug surface adjacent said second slot end.

4. A lock according to claim 3 wherein said master key when inserted into said keyway, causes said pins within said first plug hole to be arranged so that a juncture between said pins coincides with said outer cylindrical surface of said plug.

5. A lock according to claim 4 wherein said code key causes said pins within said first plug hole to be arranged so that a juncture between said pins coincides with said first end of said floor of said slot, and no juncture between said pins coincides with said outer cylindrical surface of said plug.

6. A lock according to claim 3 wherein said first plug hole registers with a first one of said cylinder holes in said second row when said plug is in said second position, the diameter of said top pin within said first cylinder hole being larger than the diameter of said first plug hole.

7. A lock according to claim 1 wherein said cylinder housing includes a third row of cylinder holes extending along the length of said bore and being circumferentially spaced from said first and second rows of said cylinder holes.

8. A lock according to claim 7 wherein each of said cylinder holes in said third row contains a top pin slidable therein, a plurality of second middle pins having different lengths than said first mentioned middle pins, said second middle pins being within said cylinder holes of said third row and located radially inwardly from said top pins within said third row of said cylinder holes, spring means within said third row of said cylinder holes for yieldably urging said top pins and said second middle pins radially inwardly.

* * * * *